US007766695B1

(12) United States Patent
Czarnecki et al.

(10) Patent No.: US 7,766,695 B1
(45) Date of Patent: Aug. 3, 2010

(54) POWER INLET BOX WITH REMOVABLE SOCKET MOUNTING MEMBER

(75) Inventors: Neil A. Czarnecki, Mt. Pleasant, WI (US); Kurt Von Eckroth, Wales, WI (US)

(73) Assignee: Reliance Controls Corporation, Racine, WI (US)

( * ) Notice: Subject to any disclaimer, the term of this patent is extended or adjusted under 35 U.S.C. 154(b) by 128 days.

(21) Appl. No.: 12/026,133

(22) Filed: Feb. 5, 2008

(51) Int. Cl.
*H01R 13/60* (2006.01)

(52) U.S. Cl. ..... 439/528; 174/58; 174/67; 439/142

(58) Field of Classification Search ..... 174/67, 174/58; 439/528, 131, 142
See application file for complete search history.

(56) References Cited

U.S. PATENT DOCUMENTS 4,138,187 A * 2/1979 Brygger ..... 439/142
4,797,507 A * 1/1989 Lofving ..... 174/503
4,857,004 A 8/1989 Poirier
5,078,614 A 1/1992 Shotey
5,107,075 A 4/1992 Currier, Jr.
5,264,662 A 11/1993 Kennedy
5,527,993 A 6/1996 Shotey et al.
5,984,719 A * 11/1999 Flegel ..... 439/528
6,028,268 A * 2/2000 Stark et al. ..... 174/67
6,674,031 B1 1/2004 Flegel
7,554,034 B2 * 6/2009 Smith ..... 439/137
2007/0235206 A1 * 10/2007 Dinh ..... 174/67

* cited by examiner

*Primary Examiner*—Briggitte R Hammond
(74) *Attorney, Agent, or Firm*—Boyle Fredrickson, S.C.

(57) ABSTRACT

A power inlet box suitable for outdoor or external use is configured in such a manner that an electrical socket may be electrically coupled to an interior load before the electrical socket is secured within the power inlet box. The power inlet box may be formed from weather or otherwise corrosion resistant material such as plastic and is designed such that the electrical socket faces downward toward an exposed lower end of the power inlet box. The electrical socket is supported by a mounting member that may be removably mounted to the power inlet box to secure the electrical socket within the power inlet box.

26 Claims, 8 Drawing Sheets

POWER INLET BOX WITH REMOVABLE SOCKET MOUNTING MEMBER

BACKGROUND OF THE INVENTION

The present invention is generally directed to a power inlet box, which is typically mounted to the exterior of a building and which provides an inlet for the supply of electrical power from an auxiliary power source such as a generator, and more particularly to a power inlet box having a removable socket mounting member that allows a user to connect the socket to the power leads of a load prior to the socket being secured within the power inlet box.

In an auxiliary power supply system, a remote power generator is interconnected with a power inlet box which is typically mounted to the exterior of a building or dwelling. The power inlet box is, in turn, typically interconnected with a transfer switching arrangement, which is connected to the main electrical panel or load center of the building. A cord is interconnected with the power outlet of the generator and with a power inlet receptacle or socket associated with the power inlet box for providing power from the generator through the power inlet box to the transfer panel, and ultimately to the main electrical panel in order to supply power to certain circuits of the building in the event of a power outage or the like.

Prior art power inlet boxes generally include a base member adapted to be mounted to a wall of the building, and a cover member or assembly that is movably interconnected with the base member. The base member defines an internal cavity, and the cover member is configured to enclose the internal cavity. The power inlet includes a a power receptacle or socket to which is attached various electrical wiring from the building. The socket includes an access cover, which is pivotable between a closed position in which the access cover prevents access to the power receptacle socket structure, and an open position providing access to the power receptacle socket structure.

With such conventional power inlet boxes, the power inlet socket is fixedly secured to the power inlet box, and thus is fixed in position on the wall of the building to which the power inlet box is mounted. This can be problematic when making the electrical connections between the power inlet socket and the electrical circuits, i.e., the transfer panel, of the building. More particularly, the fixed position of the socket, combined with the relatively tight interior volume of the power inlet box, provides very little space for a user to connect the wires to the terminals of the power inlet socket.

Therefore, there is a need in the art for a power inlet box suitable for outdoor use that allows a user to first mount a portion of the power inlet box to an exterior support structure, make the necessary electrical connections between the power inlet socket and the electrical circuits to which power is to be provided with the power inlet socket detached from the power inlet box, and then secure the power inlet socket to the power inlet box.

SUMMARY OF THE INVENTION

The present invention is directed to a power inlet box suitable for outdoor or external use and configured in such a manner that electrical wiring may be electrically coupled to the electrical socket before the electrical socket is secured to the power inlet box. The power inlet box may be formed from weather resistant material such as plastic, and may be designed such that the electrical socket faces downward. In this regard, the power inlet box may have an exposed bottom opening so that it complies with relevant electrical codes.

In one embodiment, the power inlet box includes a base or frame that may be mounted to the wall of a building. The frame receives an electrical socket mounting member that is configured to be protected against rain, snow, dust, dirt, and the like by a removable outer cover. The mounting member may be mounted to the frame in a number of ways. For instance, a groove may be formed along an interior wall of the frame and the mounting member may be inserted into the groove. In a preferred embodiment, the mounting member may be mounted to the frame after an electrical socket supported by the mounting member is electrically coupled to power leads of an interior load, such as those used to connect the electrical socket to a transfer panel. In this manner, a user is not confined by the size of the power inlet box when making the necessary electrical connections to the socket. The mounting member is secured to the frame such that the face of the electrical socket faces downwardly relative to the power inlet box. The bottom of the power inlet box is open, which allows a user to access the electrical socket without removing a cover or other member of the power inlet box. The mounting member is mounted to the frame so that the electrical socket is upwardly recessed from the bottom of the power inlet box.

Therefore, it is one object of the present invention to provide a power inlet box that provides access to an electrical socket without requiring removal of an otherwise fixed cover plate or similar member.

It is another object of the present invention to provide a power inlet box segmented into separate components such that a frame of the power inlet box can be secured to a support structure and then the necessary electrical connections between the electrical socket and the interior electrical components may be made without the user being restricted by the location and/or interior volume of the power inlet box. After the electrical connections are made, the user can then mount the electrical socket within the power inlet box and then secure a cover to the frame, to shield the electrical socket from weather, such as rain, sleet, snow and the like.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout.

In the drawings.

DETAILED DESCRIPTION

Figure 1:
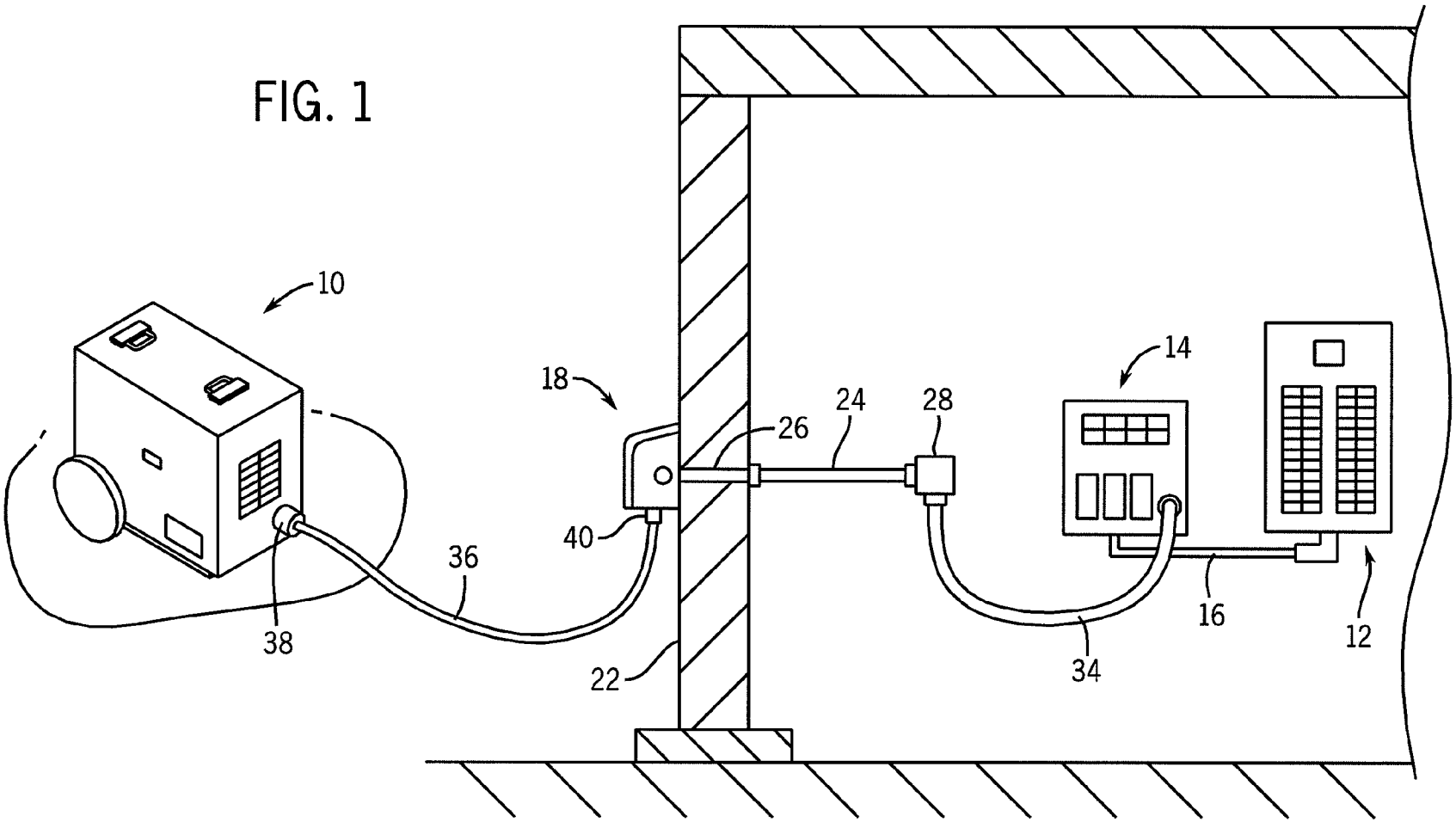
FIG. 1 is a partial section view of a building showing interconnection of a remote power generator with the main electrical panel of the building using the power inlet box of the present invention.

FIG. 1 illustrates a system for interconnecting a remote power generator 10 with the main electrical distribution panel or load center 12 of a building. A manual transfer panel 14 is mounted to the building interior wall adjacent main panel 12, and is connected to main panel 12 via wiring disposed within a conduit 16 extending therebetween, in a manner as is known. Alternately, the transfer panel 14 may be an automatic transfer panel, as is known in the art.

A power inlet box 18, in accordance with the present invention, is mounted to the exterior of a building wall, shown at 22. A conduit 24 extends from the interior of building wall 22, and is interconnected with power inlet box 18 via any satisfactory, conventional wire routing structure, such as a conduit 26 extending through wall 22 for interconnection with conduit 24. A junction box 28 is mounted to the interior wall of the building, and a flexible cord 34 is attached to junction box 28. Flexible cord 34 has a plug which is engageable with a power inlet receptacle provided on transfer panel 14, to complete the electrical connection between power inlet box 18 and manual transfer panel 14 for supplying power to main panel 12 in the event of a power outage or the like. Alternatively, cord 34 may be replaced with wiring contained within a conduit or sheath, to provide a wired connection between power inlet box 18 and transfer panel 14 rather than a plug-type connection. In addition, it is understood that power inlet box 18 may be mounted in any desired location on the building, e.g. on the interior wall, and is not limited to securement to the exterior wall of the building as shown.

A flexible cord 36 includes a plug 38 at one end which is engageable with the power outlet of generator 10. At its opposite end, cord 36 includes a connector 40 engageable with power inlet box 18 for supplying power to power inlet box 18 from generator 10. When cord 36 is installed in this manner, auxiliary power supplied by generator 10 is transferred to manual transfer panel 14 through inlet box 18 and the wiring in conduit 26, conduit 24, junction box 28 and cord 34 to transfer panel 14. The wiring in conduit 16 transfers power to selected circuits of main panel 12 according to the position of certain switches on transfer panel 14, so as to provide power to such circuits in the event of a power outage, in a manner as is known.

Figure 2:
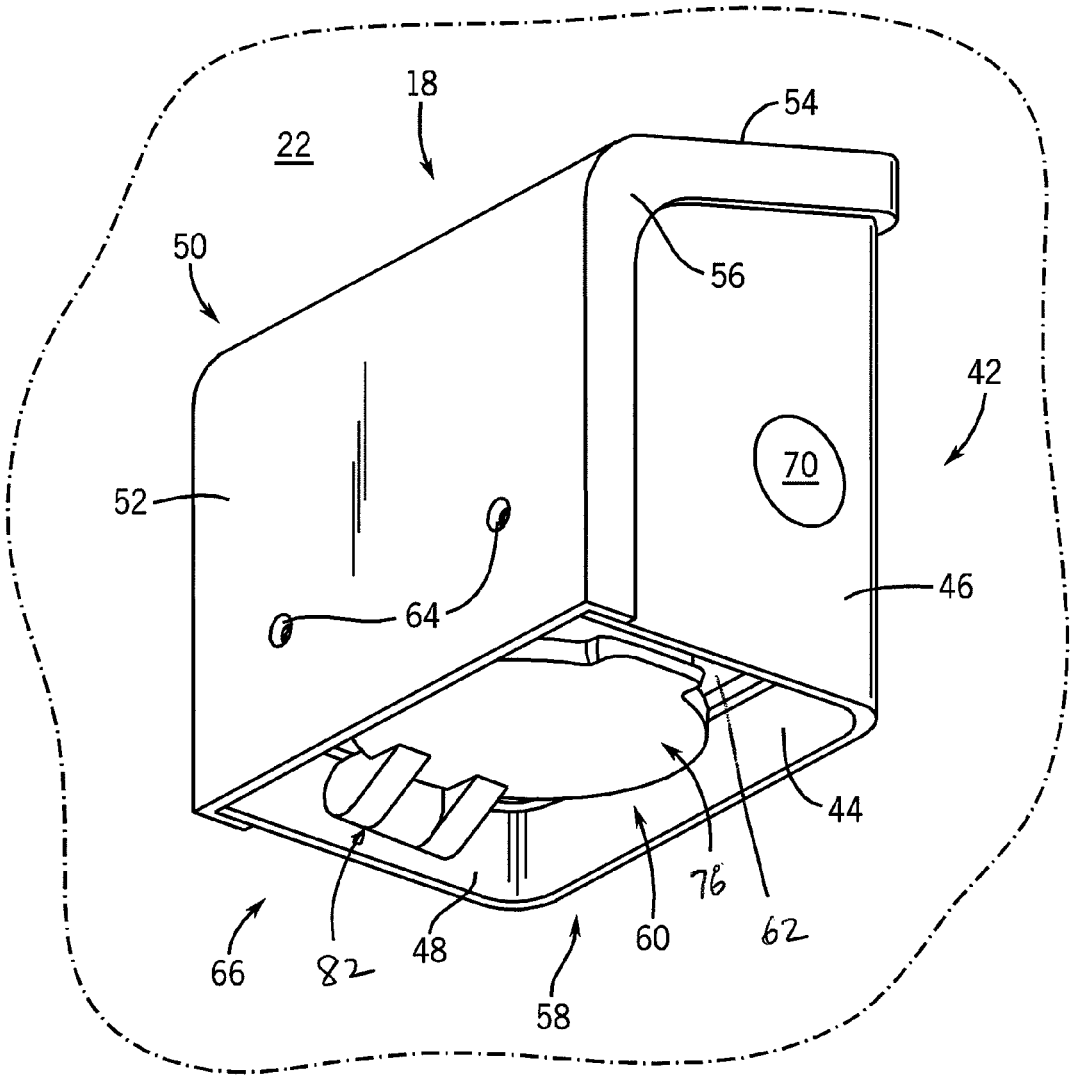
FIG. 2 is an isometric view of the power inlet box of the present invention shown mounted to an exterior wall of a dwelling.

Referring now to FIG. 2, the power inlet box 18 in accordance with the invention includes a base or frame 42 that is defined by a rear wall 44, a first sidewall 46, and a second sidewall 48. In one embodiment, the rear wall 44 and sidewalls 46, 48 are integrally formed as a single unit such that no seams are formed between the rear wall 44 and each sidewall 46, 48. When assembled, the power inlet box 18 further includes a cover 50 defined by a front wall 52 and a top 54. In a preferred embodiment, the cover 50 is formed as a single unit such that there is no seam between the front wall 52 and the top 54. In the illustrated embodiment, the front wall 52 and the top 54 also include an integral side flange 56 at each side, and each side flange 56 is configured to overlie the upper end portion and outer end portion of one of frame sidewalls 46, 48. Representatively, frame 42 and cover 50 may be formed of a thermoplastic material in an injection molding process, although it is understood that any other satisfactory material and forming method may be employed.

When assembled, the cover 50 fits onto the frame 42 such that the top 54 of cover 50 rests atop the rear wall 44 and the sidewalls 46, 48 of frame 42. The front wall 52 of the cover 50 engages the outer edges of the sidewalls 46, 48 generally perpendicular to the plane of the top 54. Collectively, the frame 42 and the cover 50 define an interior volume 58 in which an electrical socket 60 may be removably mounted. As will be described more fully below, the electrical socket 60 is secured to and carried by a mounting member, in the form of a mounting plate 62, which is mounted to an interior surface of the frame 42. Holes 64 formed in the front wall 52 of the cover 50 align with passages 98, FIG. 9, formed in the mounting plate 62 which, in turn, align with openings 65, FIG. 4, formed in the rear wall 44 of the frame 42. Fasteners 100, FIG. 10, such as screws or bolts, may be inserted through the front holes 64 and the passages 98 to secure the mounting plate 62 and the cover 50 to the frame 42. As shown in FIG. 2, the electrical socket 60 is recessed from an exposed bottom end 66 of the power inlet box 18.

Figure 3:
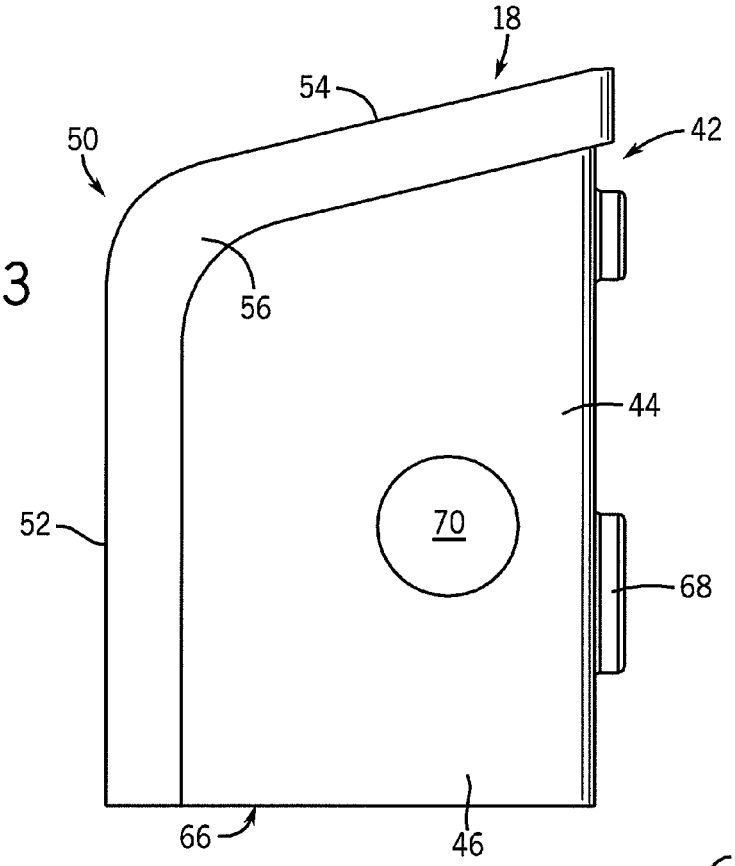
FIG. 3 is a side elevation view of the power inlet box shown in FIG. 2.

With additional reference to FIG. 3, the exposed bottom end 66 is code-compliant because the power inlet box 18 is designed to be mounted with the rear wall 44 generally flush against the surface of an exterior wall (not shown) of the building. With this orientation, the bottom end 66 faces downward. Thus, any precipitation falls along the exterior surfaces of the side walls of the frame and the front wall of the cover and not into the interior of the power inlet box 18 or into contact with socket 60.

Figure 4:
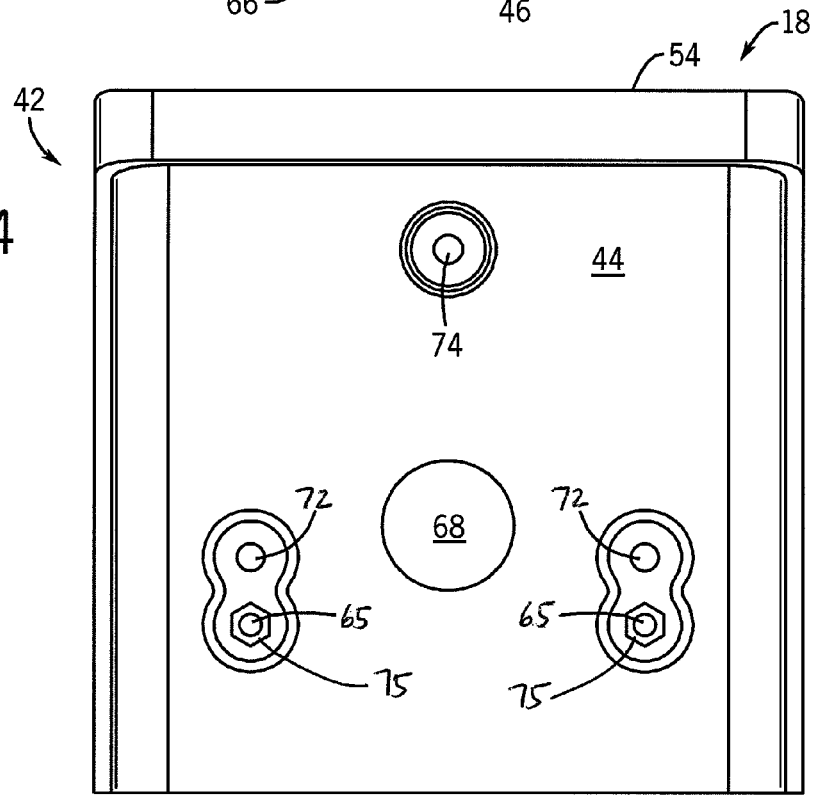
FIG. 4 is a rear elevation view of the power inlet box shown in FIG. 2.

In addition to openings 65, the rear wall 44 of the frame 42 further includes hanging holes 72, 74, as best seen in FIG. 4, through which suitable fasteners, such as screws or bolts, may be used to secure the frame 42 to the exterior wall of the dwelling. At each opening 65, a nut 75 is embedded in rear wall 44. Each nut 75 defines threads that are adapted to engage the threads of one of fasteners 100. With this construction, the fasteners 100 function to removably assemble frame 42, cover frame 42 and mounting plate 62 together. The power inlet box 18 is constructed so that the frame 42 is mounted to the exterior wall, and power connections are inserted through a knockout 68 and connected to the electrical socket 60 supported by the mounting plate 62 while the mounting plate is detached from the frame 42.

Figure 7:
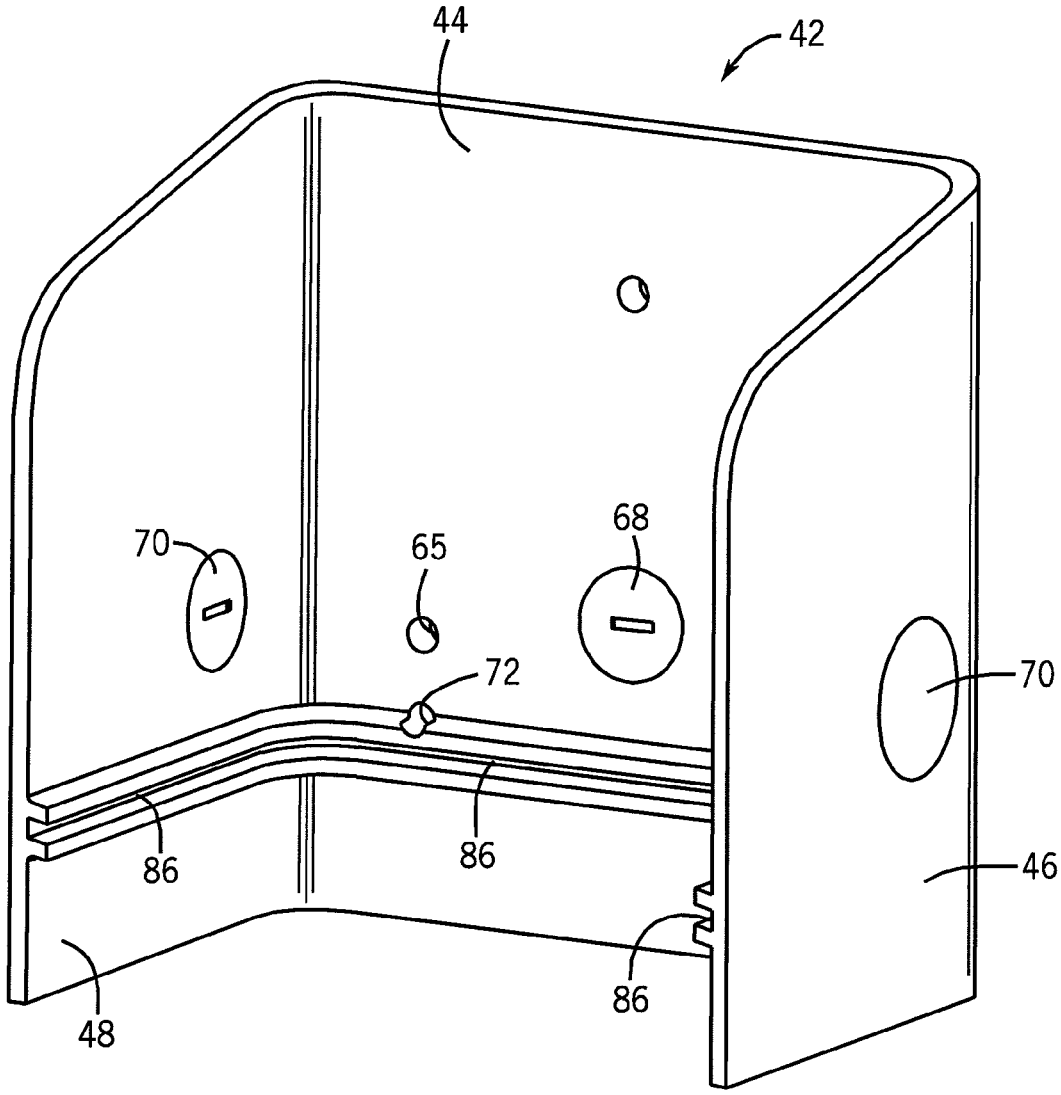
FIG. 7 is an isometric view of the frame for the power inlet box shown in FIG. 2

The inner surfaces of rear wall 44 and sidewalls 46, 48 of frame 42 include a pair of spaced ribs that define a groove or channel 86, as shown in FIG. 7. The groove or channel 86 has a shape that corresponds to the shape defined by the front and side edges of mounting plate 62, as well as a height that is slightly greater than the thickness of mounting plate 62.

The electrical socket 60 (hidden by sidewall 46 in FIG. 3) may be electrically coupled to wiring (not shown) inserted through knockout 68 formed in the rear wall 44 of the frame 42 or through one of a pair of knockouts 70 formed in the sidewalls 46, 48. In a preferred embodiment, the knockouts may also be removed by applying a blunt force to the knockouts from within the power inlet box 18. In this regard, the interior volume of the power inlet box 18 cannot be accessed by applying a blunt force to the knockouts from outside the power inlet box 18. Construction of such a knockout is more fully described in U.S. Ser. No. 12/199,490, the disclosure of which is incorporated herein.

Figure 5:
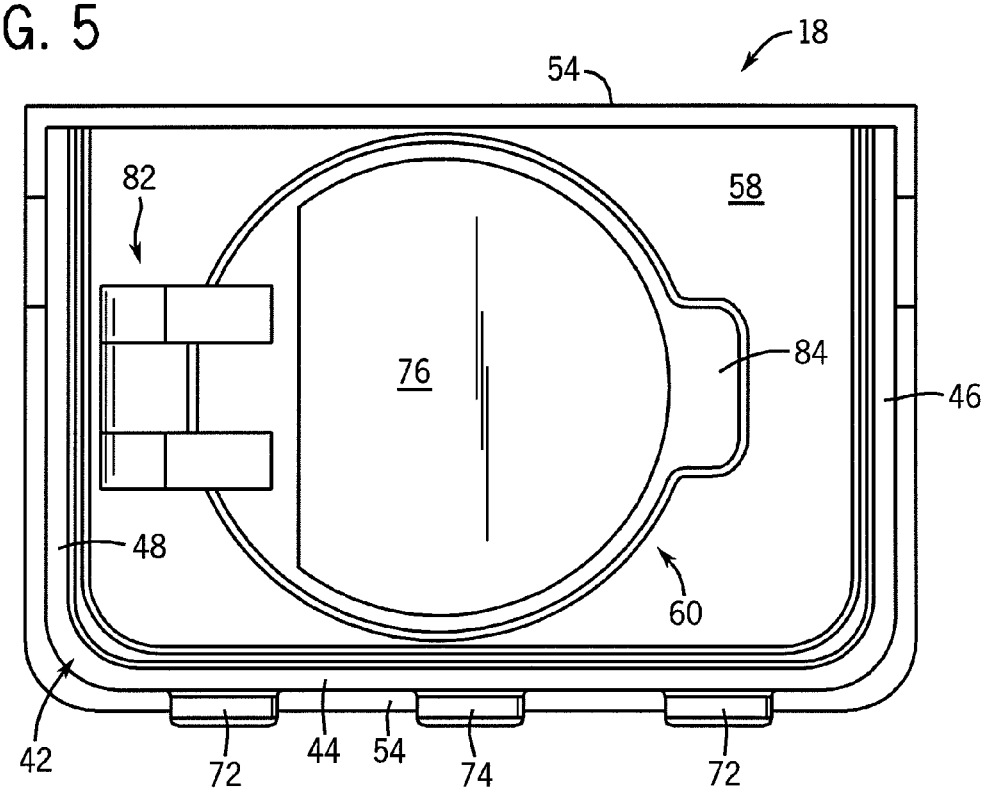
FIG. 5 is a bottom plan view of the power inlet box shown in FIG. 2.
Figure 6:
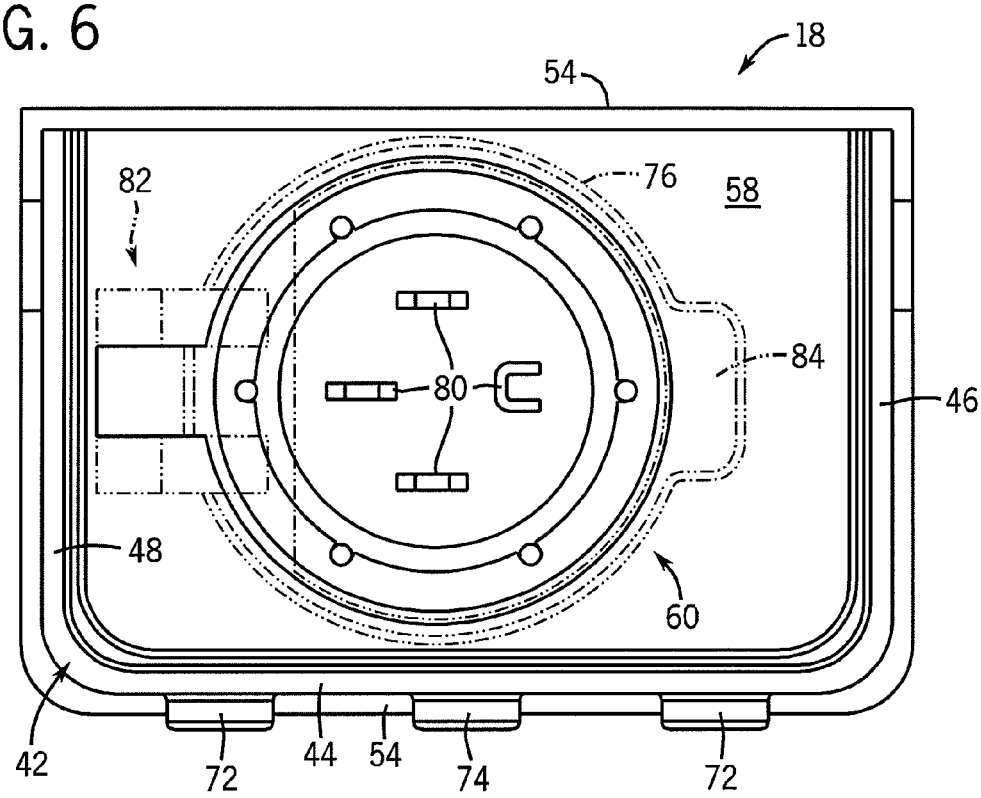
FIG. 6 is a bottom plan view of the power inlet box similar to that shown in FIG. 5 with the cap of the electrical socket hidden.

The electrical socket 60, when mounted within the power inlet box 18, is slightly recessed from the exposed bottom end 66. This recessed configuration of the electrical socket 60 isolates electrical socket 60 from environmental elements, such as rain, sleet, snow, and the like. Notwithstanding the environmental protection provided by the power inlet box 18, the electrical socket 60 also includes a cap 76 that is coupled to a cylindrical body 78 that forms a housing for conductive blades 80, as best shown in FIGS. 5-6. The cap 76 is coupled to the body 78 using a hinge structure 82 that allows the cap 78 to be opened, thereby exposing the blades 80 without detaching the cap 78 from the electrical socket 60. The hinge structure 82 includes a spring (not shown) that biases the cap 78 to a closed position, as is known in the art. Preferably, the cap 78 has a flange or tab 84 that can be easily grasped and pulled to move the cap 78 from a normally closed position to an open position.

Figure 8:
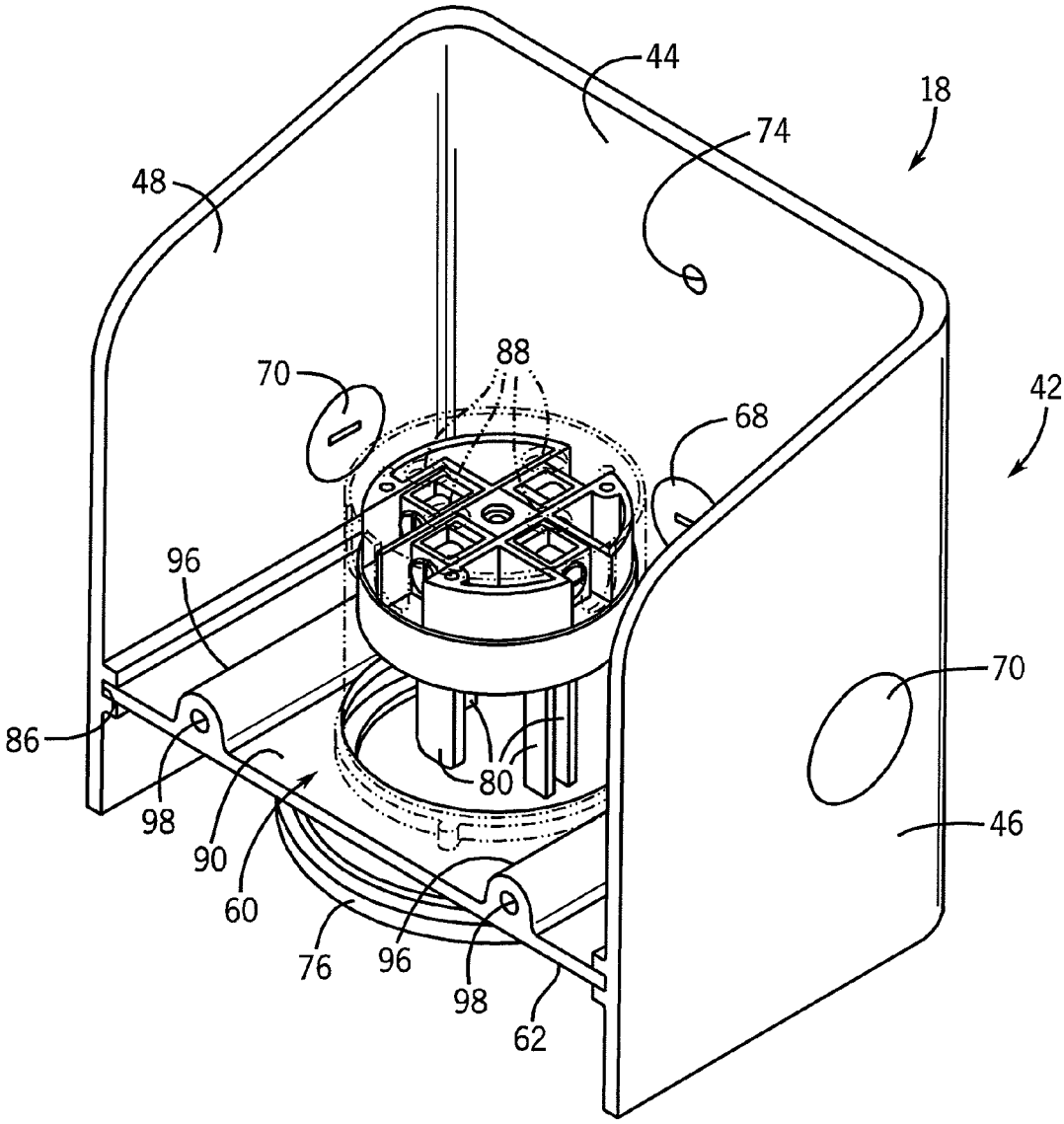
FIG. 8 is an isometric view of the power inlet box shown in FIG. 2 with the mounting member supporting the electrical socket mounted to the frame shown in FIG. 7.

As further illustrated in FIG. 8 (which shows the cylindrical housing of socket 60 in phantom), the electrical socket 60 includes connectors 88 as known in the art for connecting power leads (not shown) from a load, such as a transfer panel 14, to the conductive blades 80 so that when the connector 40 is engaged with electrical socket 60, power is available from the generator 10 to the load 14.

Figure 9:
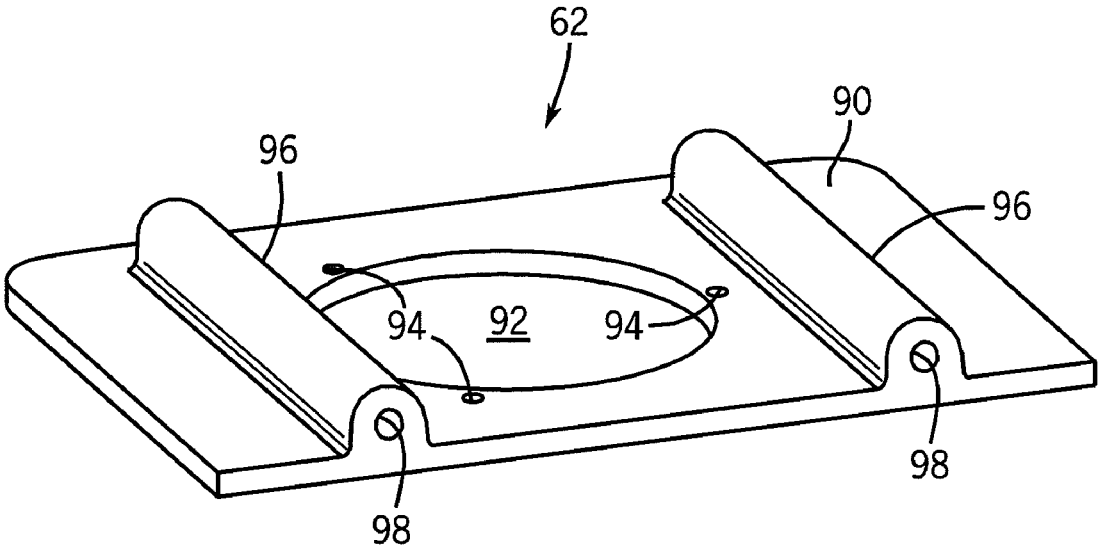
FIG. 9 is a perspective view of the electrical socket mounting member in the power inlet box of FIG. 8.
Figure 10:
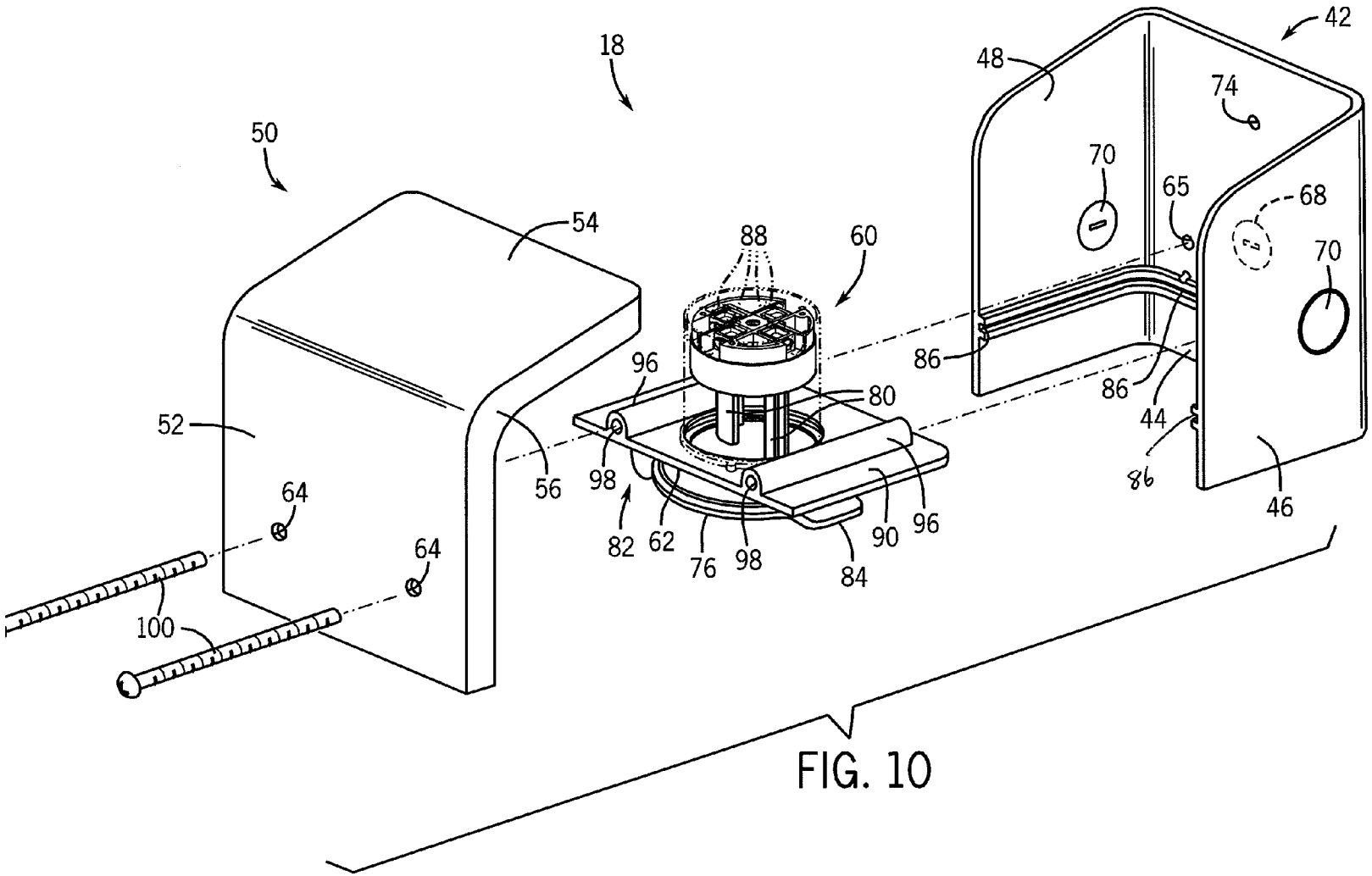
FIG. 10 is an exploded isometric view of the power inlet box shown in FIG. 2.

Referring to FIG. 9, the mounting plate 62 has a generally planar surface 90 with an opening 92 formed therein. The opening 92 is sized to receive the electrical socket 60. In one embodiment, the electrical socket 60 includes fasteners (not shown) that extend through holes 94 to connect the electrical socket 60 to the mounting plate 62. Raised portions 96 extend above the planar surface 90 and each defines a respective elongated passage 98. The mounting plate 62 is constructed such that the elongated passages 98 align with openings 65 of the rear wall 44. When the cover 50 is placed onto the frame 42, the holes 64 formed in the front wall 52 of the cover 50 will also align with elongated passages 98. Thus, a fastener 100, such as a bolt, may be inserted into the holes 64 through elongated passages 98 and threadingly engaged with nuts 75 in openings 65 of the rear wall 44 to secure the mounting plate 62 and cover 50 to the frame 42. Because the cover 50 and frame 42 collectively enclose all but the bottom end 66 and further because the electrical socket 60 faces downward, the face of the electrical socket 60 can be accessed without removing cover 50 from the frame 42. Representatively, mounting plate 62 may be formed of a thermoplastic material in an injection molding process, like frame 42 and cover 50, although it is understood that any other satisfactory material and forming method may be employed.

In use, the power inlet box 18 is constructed such that a user can first fix the frame 42 to the exterior wall of a dwelling using fasteners through mounting holes 72, 74 in rear wall 44. The user can then hold mounting plate 62 in his or her hand separately from frame 42, and then make the necessary electrical connections to the electrical socket 60, which is mounted to and carried by mounting plate 62. The user then mounts the electrical socket 60 via mounting plate 62 to the frame 42, such that mounting plate 62 is engaged within groove 86 and supported by the ribs that define groove 86. The cover 50 may then be secured to the frame 42, such that cover 50 and frame 42 are securely fastened together, with mounting plate 62 therebetween, using fasteners 100. The groove 86 is formed at a height from the bottom of the rear wall 44 and sidewall 46, 48 such that, when the mounting plate 62 is positioned within the groove 86, the electrical socket 60 will be recessed within the interior volume 58 of the power inlet box 18, as shown in FIG. 8.

It is contemplated that the components of the power inlet box 18 may be packaged as a kit. In this regard and referring to FIG. 10, the frame 42, cover 50, electrical socket 60, mounting plate 62, and fasteners 100 may be packaged together with appropriate assembly instructions. As noted above, the construction of the power inlet box 18 allows the frame 42 to be mounted to the exterior wall of a dwelling or building without the electrical socket 60 coupled to the frame 42, so that the user can make the electrical connections to socket 60 without socket 60 being fixed in position on the building.

While the mounting member has been shown and described as a mounting plate 62 that is slidably received by the frame 42, it is understood that the mounting member may have any desired configuration that is separate from the frame or base, and may be engageable with the frame or base using any desired mounting technique. For instance, hangers may be formed on the interior surfaces of the frame and the mounting member may be retained by the hangers. In another example, the mounting plate may include teeth that interface with corresponding slots formed along the interior surface of the frame. It is recognized that other types of mountings different from those described herein may be used and are deemed within the scope of the present invention. It is also understood that, which the mounting member and the cover are shown and described as being separate components, the mounting member and the cover may be formed as a separate subassembly. In a construction such as this, the base member is first secured to the support structure such as a wall, and the user makes the electrical connections to the socket while holding the mounting member and cover member subassembly. The mounting member and cover member subassembly is then secured to the base member to form the final power inlet box assembly.

Additionally, while the power inlet box 18 has been described as being mounted on the outside wall of a building for electrically connecting a transfer panel to an electric generator, it is understood that the present invention may also be used to provide ease of connection for any electrical receiver, socket or outlet that is adapted to be connected to any stationary structure such as a wall, whether in an indoor or outdoor environment.

Various alternatives and modifications are contemplated as being within the scope of the following claims, which particularly point out and distinctly claim the subject matter regarded as the invention.

We claim:

1. An electrical connection assembly mountable to a support, comprising:

a base member adapted for mounting to the support;

an electrical connection member separate from the base member;

releasable engagement structure associated with the base member and the electrical connection member, wherein the releasable engagement structure is configured and arranged to enable the electrical connection member to be releasably engaged with and disengaged from the base member; and a cover member adapted to be secured to the base member, wherein the cover member and the base member are configured to define an interior when engaged together, wherein the cover member and the electrical connection member are configured such that, when the cover member is secured to the base member, the cover member engages the electrical connection member and maintains the electrical connection member in engagement with the base member within the interior defined by the cover member and the base member.

2. The electrical connection assembly of claim 1 further comprising at least one fastener adapted to secure the cover member and the base member together.

3. The electrical connection assembly of claim 2 wherein the electrical connection member includes mounting structure configured to receive the fastener.

4. The electrical connection assembly of claim 1 wherein the base member includes a rear wall and a pair of sidewalls, and wherein the cover member includes a front wall, wherein the base member and the cover member are configured to collectively define an opening oriented transverse to a plane of the rear wall, sidewalls, and front wall, and wherein the electrical connection member defines a face disposed within the opening when the cover member is secured to the base member and engages the electrical connection member to maintain the electrical connection member in engagement with the base member.

5. The electrical connection assembly of claim 1 wherein the base member, the electrical connection member, and the cover member are formed separately from each other, and further comprising one or more fasteners for securing the cover member and the electrical connection member to the base member.

6. The electrical connection assembly of claim 5 wherein the base member, the electrical connection member, and the cover member are formed of a corrosion resistant material.

7. The electrical connection assembly of claim 1 further comprising at least one knockout formed in the base member.

8. The electrical connection assembly of claim 1 wherein the electrical connection member is configured to close the interior defined by the base member and the cover member.

9. The electrical connection assembly of claim 1 wherein the support comprises an exterior surface of a building.

10. The electrical connection assembly of claim 1 wherein the releasable engagement structure associated with the base member and the electrical connection member comprises a slidable engagement arrangement that enables the electrical connection member to be slidably engaged with, the base member.

11. A mounting arrangement for an electrical connector, the mounting arrangement comprising:

a frame adapted to be secured to a support surface;

a mounting member separate from and engageable with the frame and adapted to support the electrical connector, such that an electrical connection to the electrical connector can be made with the mounting member detached from the frame, wherein the mounting member defines a pair of spaced apart edges;

a sliding connection between the frame and the edges of the mounting member, wherein the sliding connection enables the mounting member to be slidably engaged with and disengaged from the frame; and retainer means for maintaining the mounting member in engagement with the frame, wherein the retainer means is configured and arranged to be secured to the frame and engaged with the mounting member when the mounting member is slidably engaged with the frame for preventing the mounting member from being disengaged from the frame.

12. The electrical connector mounting arrangement of claim 11 wherein the retainer means comprises a cover that together with the frame forms an internal cavity for the electrical connector when the mounting member is engaged with the frame.

13. The electrical connector mounting arrangement of claim 12 wherein the cover and the frame, when the cover is attached to the frame, collectively define an opening, and wherein the mounting member is configured to close the opening when the mounting member is engaged with the frame and maintained in engagement with the frame by the cover.

14. The electrical connector mounting arrangement of claim 12 further comprising a fastener adapted to secure the cover to the frame.

15. The electrical connector mounting arrangement of claim 12 wherein the cover, the frame and the mounting member comprise separate components that are configured and arranged to be secured together and to maintain the mounting member in engagement with the frame.

16. The electrical connector mounting arrangement of claim 15 wherein the cover and the frame, when the cover is secured to the frame, collectively define an opening through which an internal cavity defined by the cover and the frame can be accessed.

17. The electrical connector mounting arrangement of claim 15 further comprising a fastener adapted to fasten the cover and mounting member to the frame.

18. The electrical connector mounting arrangement of claim 11 wherein the mounting member comprises a planar body that defines the pair of spaced apart edges and wherein the planar body defines an opening adapted to receive the electrical receptacle.

19. An electrical connection assembly comprising:

an electrical connector having an interface adapted to engage a power cord;

a connector mounting arrangement having a frame and a mounting member adapted to support the electrical connector, wherein the frame is adapted to be fixedly coupled to support surface, wherein the mounting member is removable from the frame when the frame is fixedly coupled to the support surface to allow connection of the electrical connector to the power cord remote from the frame followed by engagement of the mounting member with the frame; and a cover separate from the frame and the mounting member, wherein the cover is adapted to be fastened to the frame and wherein the cover and the frame collectively define an interior when the cover is fastened to the frame, and wherein the mounting member and the cover include engagement structure that maintains the mounting member in engagement with the frame when the cover is fastened to the frame, and wherein the mounting member is configured to enclose the interior defined by the frame and the cover when the cover is fastened to the frame, and to position the electrical connector interface within the interior.

20. The electrical connection assembly of claim 19 wherein the mounting member is removably engaged with the frame via a slidable connection between the mounting member and the frame.

21. The electrical connection assembly of claim 20 further comprising at least one fastener for securing the cover, the mounting member, and the frame to one another.

22. The electrical connection assembly of claim 21 wherein the mounting member comprises a planar member with an opening formed therein to receive the electrical connector, and wherein the planar member includes an elongated passage adapted to receive the fastener.

23. A method of mounting an electrical connector to a support, comprising:

mounting a base member to the support, the base member having a frame that includes a set of walls, at least one of which includes an opening, wherein the set of walls includes engagement structure;

routing electrical leads through the opening;

connecting the electrical leads to an electrical connection member supported on a mounting member that is separate from the base member;

after making the connection, removably engaging the mounting member with the engagement structure of the base member walls; and maintaining the mounting member in position relative to the base member by securing a separate retaining member to the base member, wherein the separate retaining member is configured to engage the mounting member to maintain the mounting member in engagement with the engagement structure of the base member walls.

24. The method of claim 23 wherein securing the separate retaining member to the base member comprises attaching a cover to the base member that secures the mounting member to the base member.

25. The method of claim 24 wherein attaching the cover includes passing at least one fastener through an opening in the cover, an opening in the mounting member, and an opening in the base member, and securing the fastener within the openings.

26. The method of claim 23 wherein removably engaging the mounting member with engagement structure of the base member walls includes sliding at least a pair of edges defined by the mounting member into a pair of grooves defined by a spaced apart pair of the base member walls.

* * * * *